United States Patent [19]

Orimoto et al.

[11] 4,099,449

[45] Jul. 11, 1978

[54] ELECTROMAGNETIC BUCKET POSITIONER FOR LOADER VEHICLES

[75] Inventors: Koji Orimoto; Masataka Uno, both of Komatsu; Yoshio Oomachi, Hiratsuka; Yoshitaka Nishimura, Hirakata, all of Japan

[73] Assignee: Kabushiki Kaisha Komatsu Seisakusho, Tokyo, Japan

[21] Appl. No.: 746,812

[22] Filed: Dec. 2, 1976

[30] Foreign Application Priority Data

Dec. 4, 1975 [JP] Japan ..... 50/162156

[51] Int. Cl.[2] ..... F15B 13/16; F15B 11/16; F15B 13/06

[52] U.S. Cl. ..... 91/358 A; 91/413; 91/414; 214/762

[58] Field of Search ..... 91/358 A, 358 R, 413; 214/262, 763, 764

[56] References Cited

U.S. PATENT DOCUMENTS 3,667,723 6/1972 Schneider ..... 91/358 A 3,782,248 1/1974 Fuzell ..... 91/358 A 3,823,647 7/1974 Campbell ..... 91/358 A

*Primary Examiner*—Paul E. Maslousky

*Attorney, Agent, or Firm*—Armstrong, Nikaido, Marmelstein & Kubovcik

[57] ABSTRACT

An electromagnetic bucket positioner having an electromagnet disposed to selectively latch, when energized, a directional control valve of a bucket positioning system. The electromagnet is arranged in such a manner that only when a manually operable control lever is shifted to a rack-back position, the electromagnet serves to latch the control lever in the rack-back position. A normally-closed electric switch is provided and is adapted to be opened upon selected movement of the piston rod of a hydraluic cylinder associated therewith, so as to interrupt electric current flow to the electromagnet, de-energize the same and release the control lever. A loose spring device is provided in the system to facilitate movement of the control lever from the rack-back position if and when desired.

5 Claims, 6 Drawing Figures

ELECTROMAGNETIC BUCKET POSITIONER FOR LOADER VEHICLES

BACKGROUND OF THE INVENTION

1. Field of the Invention

This invention relates to an imporvement of a device for controlling the position and direction of a bucket of a loader vehicle.

2. Description of the Prior Art

There is disclosed in the Japanese Utility Model Publication No. 30967/1974, a conventional means for automatically stopping in a desired position a bucket adapted to be actuated to tilt and dump by the action of a bucket tilting cylinder. The conventional means comprises, as shown in FIG. 1, a bucket cylinder "*a*" provided with a piston rod "*b*", the leading end "*c*" of which may extend between extreme positions "A" and "B" through an intermediate detecting position "C" by dump operation. When the leading end "*c*" of the piston rod is located between the most outwardly extended position "A" and the intermediate position "C", an electromagnet for holding a change-over valve is energized. If the changeover valve is moved to a tilt-back position in this condition, the position of the change-over valve is temporarily restrained by the action of a magnetic force so that the bucket may effect tilt-back operation continuously. When the tilt-back operation has been made to achieve a posture of the bucket so that the leading end "C" of the piston rod "b" moves beyond the position "*c*", an operative member "*d*" adapted to move together with the piston rod "*b*" will be brought into contact with an electric switch "*e*" so that the latter may be deenergized and the bucket may move back to its neutral position by its self-returning action, thereby enabling the bucket to stop at that position and assume a predetermined posture.

In the above-mentioned conventional means, as described hereinabove, when the bucket occupies its dumping position and the leading end "*c*" of the piston rod "*b*" is located between the positions "A" and "C", the electromagnet is energized so as to restrain the change-over valve in position by the magnetic force thereof. Therefore, there has been a problem in which upon manipulation of the change-over valve to repeatedly effect tilting and dumping operations of the bucket under such a condition, a large manual operating force is required for the operator to overcome the magnetic force, and so not only it casts a burden for him, but also it becomes impossible for him to effect the change-over operation.

According to the conventional means, there has been another problem in which when the leading end "*c*" of the piston rod is retracted to any desired position between the positions "C" and "B" and stopped at that position, it is absolutely necessary to artificially hold the change-over valve so as not to allow it to return to its neutral position by its self-returning action, and such artificial holding of the change-over valve is liable to confuse the operator in operation. U.S. Pat. No. 3,823,647 discloses another type of electromagnetic bucket positioner for loader vehicles. In this device too, however, the operator is required to move the control valve from the rack-back position against the magnetic force of the electromagnet means.

SUMMARY OF THE INVENTION

It is, therefore, an object of the present invention to provide an electromagnetic bucket positioner for controlling the tilt, position, orientation, etc. of a bucket of a loader vehicle.

Another object of the present invention is to provide an electromagnetic bucket positioner which facilitates movement of the directional control valve from the rack-back position by manually overriding the resilient force of the loose spring means provided in the system.

According to the present invention, an electromagnet is provided to latch a directional control valve in a selected operative position when the control valve is moved by the operator using a control lever.

A normally-closed switch is provided in the system and is adapted to be opened upon selected movement of the piston rod of the associated hydraulic cylinder so as to interrupt electric current flow through the electromagnet, de-energize the same and release the control lever thereby allowing the control valve to reach its neutral position.

Since hydraulic fluid is no longer supplied into the hydraulic cylinder at that time, the bucket will stop at a selected (rack-back) position, and is ready for the next loading cycle.

A loose spring means is provided in the system to facilitate movement or operation of the control lever from the rack-back position if and when desired.

Other objects, features and advantages of the present invention will be readily apparent from the following description taken in conjunction with the accompanying drawings.

DETAILED DESCRIPTION OF THE PREFERRED EMBODIMENT

Figure 1:
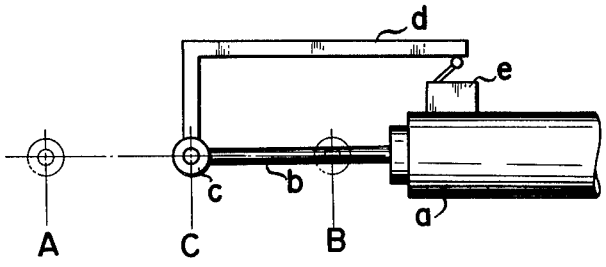
PRIOR ART FIG. 1
FIG. 1 is a schematic representation of a conventional bucket positioner for explaining the operations thereof.
Figure 3:
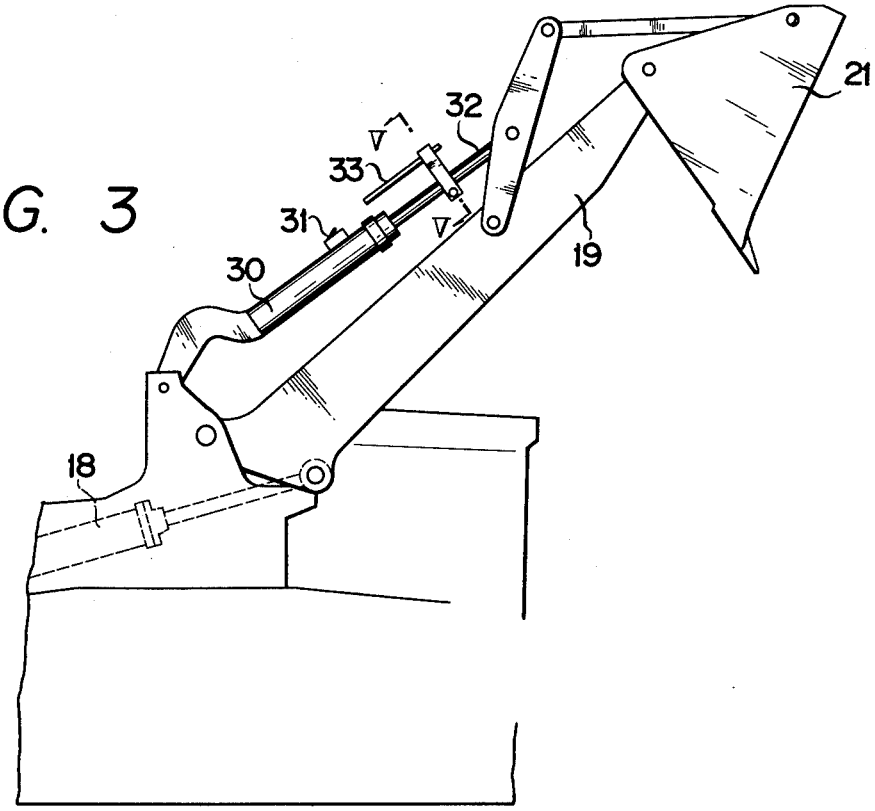
FIG. 3 is a side elevational view showing a front portion with a bucket of a loader vehicle.
Figure 2:
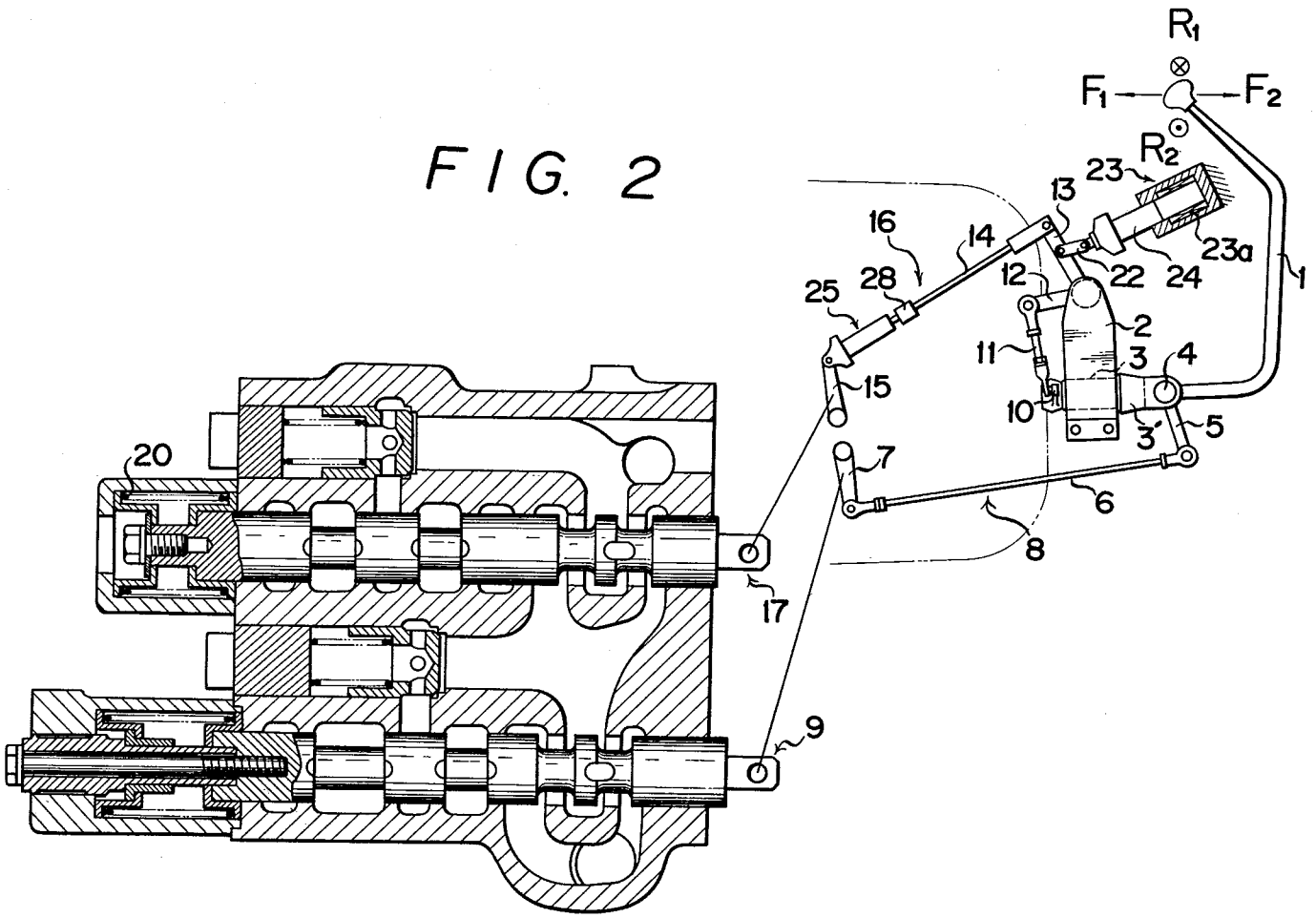
FIG. 2 is a schematic representation of a bucket positioner of the present invention.

In FIG. 2, reference numeral 1 denotes a control lever of a mono-lever type which is pivotally mounted on a shaft 4 journalled in a york 3' of a rotary shaft 3 that is rotatably supported in a bracket 2 relative to the latter, and which can be moved in both directions indicated by $F_1 - F_2$ and $R_1 - R_2$, respectively.

When the control lever 1 is moved in the direction shown by $F_1 - F_2$, a lift change-over valve or directional control valve 9 is actuated through the action of a linkage 8 for lifting operation which comprises a lever 5, a rod 6 and a lever 7. Whilst, when the control lever 1 is moved in the direction shown by $R_1 - R_2$, that is, in a direction that causes rotation of shaft 3 about its longitudinal axis a tilting and dumping change-over valve or directional control valve 17 is actuated through the action of a linkage 16 for tilting and dumping operations which comprises a lever 10, a rod 11, levers 12 and 13, a rod 14 and a lever 15. Further, when the control lever 1 is moved in the direction indicated by $R_1$, that is, into the plane of the drawing as seen in FIG. 2 and as indicated by a circle with an internal cross, the change-over valve 17 will occupy its tilt-back position, whilst it is moved in the direction indicated by $R_2$, that is, out of the plane of the drawing as seen in FIG. 2 and as indicated by a circle with a centrally positioned dot the change-over valve will assume its dumping position. Thus when the control lever 1 is moved in the direction $R_1$, the rotary shaft 3 rotates about its longitudinal axis thereby causing the lever 10, which is keyed to the shaft 3, to move the rod 11 upwardly. The upward movement of the rod 11 causes the levers 12 and 13 to rotate in a clockwise direction about their pivot axis. The clockwise rotation of the lever 13 causes the rod 14 to move to the right, as seen in FIG. 2, thereby shifting the valve 17 to the tilting back position, that is, a position that will cause hydraulic fluid to flow to the bucket cylinders 30 causing the piston rods 32 to retract and thereby raising the bucket 21, in a well known manner.

The lifting change-over valve 9 is adapted to be changed over to any of four positions i.e., upper and lower positions, holding and floating positions by the action of a detent mechanism so that it may operate to actuate a lift cylinder 18 to move a lift arm 19 upwards and downwards. The tilting and dumping change-over valve 17 is provided with a self-centering or returning spring 20 so that it may be freely changed over to any of three positions including tilting, holding and dumping positions to effect controls of the posture and direction of the bucket 21.

The above-mentioned lever 13 of the linkage 16 for tilting and dumping operation is connected through a link 22 to a movable member 24 of a electromagnet means 23. The electromagnet means 23 is adapted, when energized, to hold the movable member 24 in an inserted position. The relationship between the movable member 24 and an energizing member **23*a* is such that both members are engaged by the action of the magnetic force only when the movable member 24 is moved into the energizing member 23*a* over a predetermined stroke. Further, the arrangement is made such that the turning stroke of the linkage when the tilting and dumping change-over valve 17 is merely manipulated to effect tilting back operation can not allow the movable member 24 to be held in position by the magnetic force of the energizing member. When the control lever is moved to an extreme position in the direction $R_1$, that is, beyond the position necessary to actuate the valve 17 to initiate tilting-back of the bucket 21, the movable member 24 will only then enter the field of the electromagnet 23 and thus held in this position. This extreme movement of the control lever 1 in the direction $R_1$ and the relative positioning of the movable member 24 and the electromagnet 23** is designated as the rack-back position.

Figure 4:
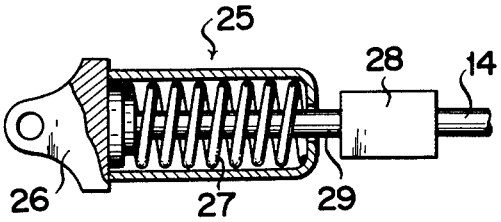
FIG. 4 is a longitudinal cross-sectional view of loose spring means employed in the present invention.

Further, disposed in the intermediate part of the rod 14 of the linkage 16 for tilting and dumping operations is a loose spring means 25. The loose spring means 25 comprises, as shown in FIG. 4, a spring housing cylinder 26, one end of which being connected to the lever 15 located on the side of the change-over valve 17, a spring 27 accommodated within the cylinder 26, and a connecting link 29 which is biased by the spring 27 within the spring housing cylinder 26 and the other end of which is connected through a coupling 28 to the rod 14. The resilient force of the spring 27 is larger than that of the self-centering or returning spring 20.

A bucket cylinder 30 is provided in the system which is fitted with an electric switch 31. A dog 33 is provided which is adapted to contact with the electric switch 31 and turn it off when the bucket 21 is tilted back so as to occupy a preselected position.

It is understood that a lift cylinder 18 and a bucket cylinder 30 can be provided on each side of the vehicle, only one pair of cylinders being shown for purposes of illustration.

Figure 5:
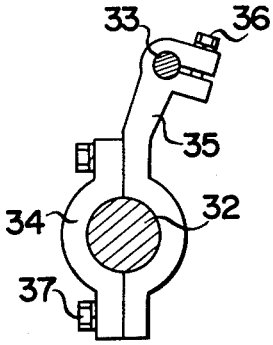
FIG. 5 is a view taken along line V—V in FIG. 3.

As shown in FIG. 5, the dog 33 is fitted to the piston rod 32 of the bucket cylinder 30 by means of hubs 34 and 35 and bolts 36 and 37. The tilt angle of the bucket 21 at rack-back position may be adjusted by the operator as desired by loosening the bolt 36 and varying the length of the dog 33 to be fitted.

Figure 6:
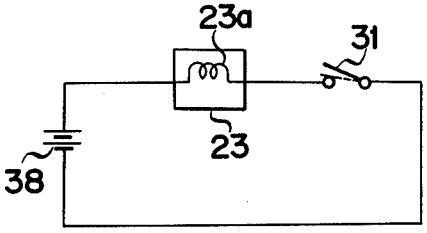
FIG. 6 shows an electric circuit of the present invention wherein the electromagnet and the switch means are arranged in series relationship.

The above-mentioned electric switch 31 is connected, as shown in FIG. 6, in series with an exciting coil **23*a* of the electromagnet means 23 and a power supply 38**.

In the above-mentioned arrangement, controls are effected to move the lift arm 19 upwards and downwards by operating the control lever 1 in the direction indicated by $F_1 - F_2$, whilst tilting and dumping of the bucket 21 are effected by operating the control lever 1 in the direction indicated by $R_1$–$R_2$. Upon tilting and dumping operation of the bucket, the loose spring means 25 will not flex under the normal tilting and dumping condition, and the rod 14 will act as a normal link. Further, the stroke of oscillation of the linkage 16 obtained at that time will not allow the movable member 24 of the electromagnet means 23 connected to the linkage 16 to be held in position by the magnetic force thereof even if the electromagnet means 23 is energized. This is because movable member 24 does not move within the field of the electromagnet **23*a*, unless it is forced against the force of the spring means 25 to move the extra distance. In operation, when the loader bucket 21 is disposed in the dump position, the operator desires to level the bucket when it is lowered on the ground so that it may assume a proper position to begin the next work cycle. To this end, it is neccesary for the operator to move the control lever 1 to the rack-back position past the normal tilt back angle in the direction shown by $R_1$, thereby actuating the directional control valve 17 to allow the bucket cylinder 30** to retract.

Thus, the change-over valve 17 is moved to occupy its tilt-back position through the action of the linkage 16 so that the bucket 21 is allowed to tilt back. However, at that time, the linkage 16 is moved beyond a required stroke, and the kinetic energy due to such movement of the linkage 16 exceeding a required stroke can be absorbed by the loose spring means 25. By such movement of the linkage 16 exceeding a required stroke, the movable member 24 of the electromagnet means 23 is moved into the range of magnetic field of the energizing or exciting member **23*a* so as to be held in position by the action of magnetic force, and consequently, the whole linkage 16 including the control lever 16 is put under restraint and held in that condition. Under such a condition, the bucket 21 is tilted back so that the dog 33 is brought into contact with the electric switch 31 to turn the latter off. As a result, the electromagnet means 23 is deenergized so as to return the whole linkage 16 to neutral condition and interrupt the supply of hydraulic fluid to the bucket cylinder 30, thereby stopping the movement of the bucket 21**.

If desired, the operator may move the directional control valve 17 from the rack-back position by manually overriding the force of the electromagnet. This operation is relatively easy and requires less forces as compared with the conventional device wherein the operator is required to move the directional control valve by manually overcoming the full force of the electromagnet, because in the present invention, the spring 27 of the loose spring 25 is under compression and this assists in overcoming the force of the electromagnet.

It is to be understood that the foregoing description is merely illustrative of the preferred embodiment of the present invention and that the scope of the invention is not to be limited thereto, but is to be determined by the scope of the appended claims.

What is claimed is:

1. An electromagnetic bucket positioner for loader vehicles including lift cylinders for the bucket and bucket cylinders for tilting the bucket, comprising a control lever adapted to move fore and aft as well as from side to side, first linkage means connected to said control lever and adapted to be moved in response to the fore and aft movment of said control lever, first valve means connected to said first linkage means for actuating the lift cylinders for the bucket, second linkage means connected to said control lever and adapted to be moved in response to the side-to-side movment of said control lever, second valve means connected to said second linkage means for actuating the bucket cylinders, electromagnet means disposed adjacent to said second linkage means in such a manner that said second linkage means is not held under restraint by the action of said electromagnet means during normal tilting back operation of said control lever and is held under restraint only when said control lever occupies a rack-back position, loose spring means disposed in said second linkage means for loosely connecting said second linkage means with said second valve means, and switching means provided on one of said bucket cylinders for interrupting electric current flow through said electromagnet in response to a predetermined movement of a piston rod of one of said bucket cylinders.

2. An electromagnetic bucket positioner for loader vehicles of claim 1 wherein said loose spring comprising a housing, a rod coaxially disposed in said housing and a spring disposed within said housing.

3. An electromagnetic bucket positioner for loader vehicles of claim 1 wherein said second valve means includes a self-centering spring disposed at one end thereof.

4. An electromagnetic bucket positioner for loader vehicles of claim 1 wherein said switching means comprises a normally-closed electric switch provided on said bucket cylinder and a dog fitted to said piston rod, the arrangement being made such that the length of said dog may be varied.

5. An electromagnetic bucket positioner for loader vehicles of claim 3 wherein resilient force of said loose spring means is larger than that of the self-centering spring disposed within said second valve means.

* * * * *